United States Patent [19]

Freeman

[11] 3,972,268

[45] Aug. 3, 1976

[54] RADIAL PISTON TYPE PUMPS OR MOTORS

[75] Inventor: Frank George Freeman, Solihull, England

[73] Assignee: Joseph Lucas (Industries) Limited, Birmingham, England

[22] Filed: Jan. 12, 1973

[21] Appl. No.: 323,235

Related U.S. Application Data

[63] Continuation of Ser. No. 800,153, Feb. 18, 1969, abandoned.

[52] U.S. Cl. ..... 91/492; 91/497

[51] Int. Cl.[2] ..... F01B 13/06

[58] Field of Search ..... 91/497, 498, 492

[56] References Cited

UNITED STATES PATENTS

| | | | |
|---|---|---|---|
| 2,646,755 | 7/1953 | Joy | 91/498 |
| 2,716,945 | 9/1955 | Presnell | 417/213 |
| 3,626,810 | 12/1971 | Morey | 91/497 |

FOREIGN PATENTS OR APPLICATIONS

| | | | |
|---|---|---|---|
| 1,377,927 | 9/1964 | France | 91/497 |

*Primary Examiner*—William L. Freeh

*Attorney, Agent, or Firm*—Holman & Stern

[57] ABSTRACT

A radial piston type pump or motor having a rotor with two rows of radial pistons and a pair of eccentrically disposed rings against which the pistons bear so that they reciprocate as the rotor rotates, the eccentricity of the rings being of equal magnitude and at opposite sides of the axis of rotation of the rotor, the eccentricity of the rings being controlled by a pair of side by side control pistons acting against the rings respectively and a spool contained in the bore communicating with the outlet of the pump to control the supply of fluid to the control pistons.

1 Claim, 2 Drawing Figures

INVENTOR
Frank George Freeman
BY Freeman, Blakeslee, Downing & Seibold
ATTORNEYS

RADIAL PISTON TYPE PUMPS OR MOTORS

This is a continuation of application Ser. No. 800,153, filed Feb. 18, 1969, now abandoned.

BACKGROUND OF THE INVENTION

The present invention relates to radial piston type pumps or motors of the kind comprising a rotor mounted in a body, pistons occupying respective radially extending bores in the rotor, inlet and outlet passages in the body with which the bores communicate in turn as the rotor rotates, and means in the body whereby the pistons can be reciprocated as the rotor rotates.

OBJECTS AND SUMMARY OF THE INVENTION

The object of the invention is to provide a radial piston type pump or motor of the kind specified in a convenient form.

In accordance with the present invention, a radial piston type pump or motor of the kind specified includes a body, an inlet and an outlet in the body, a rotor mounted within the body, two axially spaced rows of pistons movable in radial bores in the rotor, the bores communicating in turn with the inlet and with the outlet in the body, a pair of rings defining respective annular inner surfaces with which the rows of pistons engage respectively, to cause the same to be reciprocated as the rotor rotates, the rings being capable of being disposed in positions in which said surfaces are eccentric to one another with respect to an axis of rotation of the rotor, the eccentricity of the respective surfaces of the rings being of equal magnitude with respect to said axis and at opposite sides of the axis, a pair of side by side control pistons arranged to act against the outsides of the rings respectively, passage means for entry of fluid under pressure to these pistons to control the eccentricity of the rings, respectively, said passage means being capable of communicating with the outlet, the passage means including a bore containing a spool valve for controlling the supply of fluid to the two pistons respectively and the control pistons being of different sizes, with the piston of smaller size being open to high pressure fluid at all times and the piston of larger size being open to high pressure fluid under the control of the spool valve.

BRIEF DESCRIPTION OF THE DRAWINGS

The invention will now be described by way of example with reference to the accompanying drawings in which:-

DETAILED DESCRIPTION OF THE DRAWINGS

Figure 1:
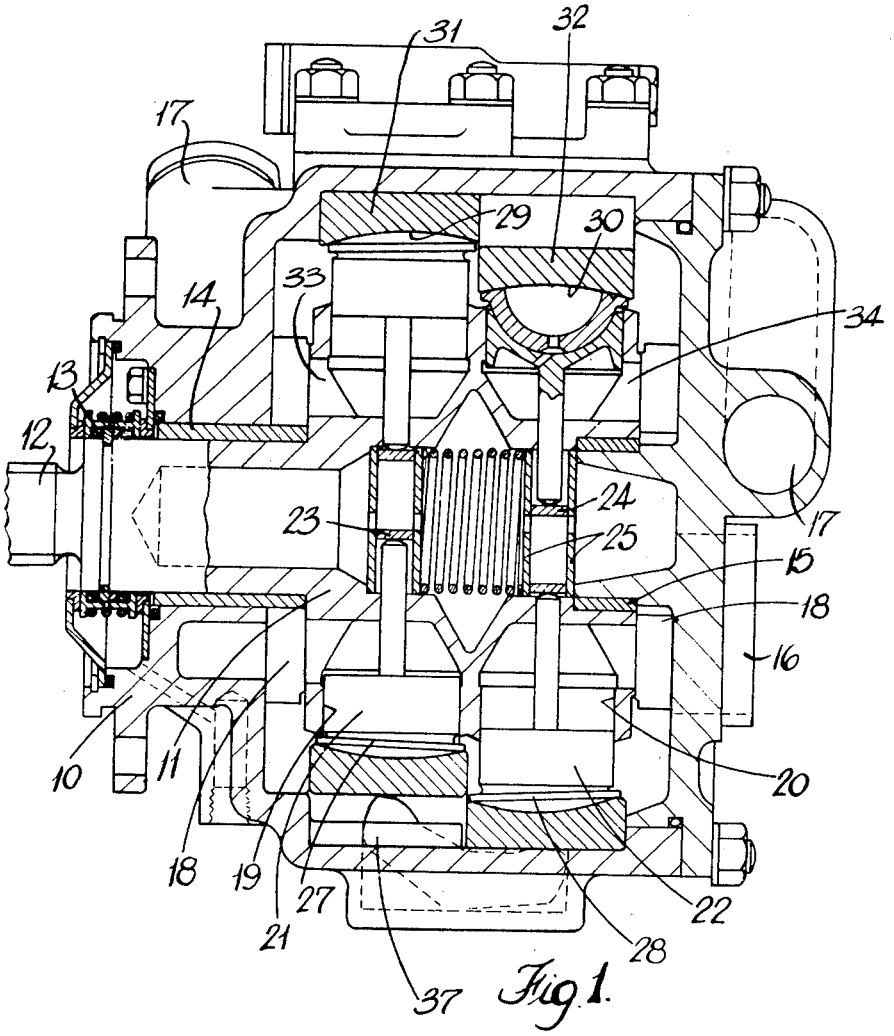
FIG. 1 is a cross-sectional side elevation view of a radial piston type pump incorporating the present invention.
Figure 2:
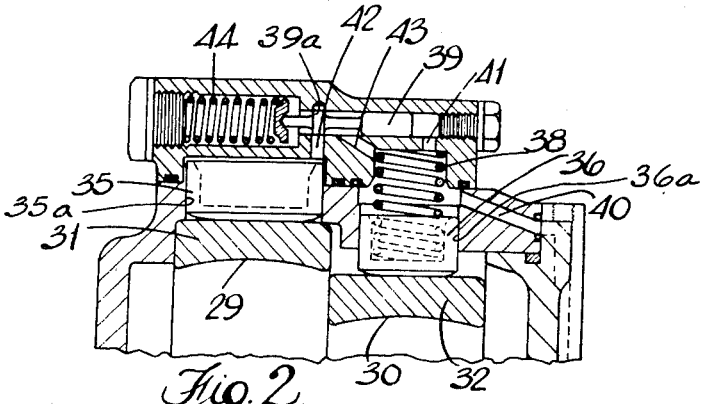
FIG. 2 is a fragmentary cross-sectional view of part of the pump.

It is to be understood that though the machine illustrated is intended for use as a hydraulic pump, it can also be used as a hydraulic motor.

The pump comprises a composite body 10 in which is mounted a rotor 11 having an integral driving shaft 12 extending out of the body 10 through a sealing device indicated generally at 13. The body 10 contains bearings 14, 15 for support of the rotor shaft 11, 12. Within the body is defined an inlet 16 which, through a passage (not shown) communicates with the interior of the body surrounding the rotor. There are also two outlets 17 communicating through passages (not shown) with ports in stationary port plates 18 disposed at opposite sides of the rotor respectively. The rotor has two annular rows of radial bores 19 and 20 containing respective sets of pistons 21, 22. The pistons are stepped as are the bores in which they are disposed, and the inner smaller diameter portions of the pistons 21, 22 bear against respective rings 23, 24 disposed within the interior of the rotor 11. The rings 23, 24 are flanked by washers 25, the outer pair of which engage respective shoulders upon the body 10 and upon the hollow interior of the shaft 11. The inner pair of washers 25 are separated by a coiled compression spring 26.

The pistons 21, 22 also have, at their outer ends, slippers 27, 28 which bear upon respective annular part-spherical surfaces 29, 30 formed on a pair of rings 31, 32 respectively. The slipper end faces are also part-spherical.

In the example illustrated, the rings 31, 32 are movably mounted in the body 10 and can occupy positions in which they are concentric with respect to one another, and also with respect to the axis of rotation of the rotor. The rings 31, 32 can also, however, occupy positions in which they are eccentric with respect to each other, and also with respect to said rotor axis. Eccentricity of the surface 29, 30 of the rings 31, 32 is of equal magnitude with respect to the axis of rotation, and at opposite sides of the axis respectively. In the example illustrated, the eccentricity of the surfaces 29, 30 is such that the sets of pistons reciprocate 180° out of phase with one another.

This arrangement minimizes the loading upon the bearings 14, 15 in the body resulting from off-set loadings from the pistons. As the pistons reciprocate, liquid is drawn in and is expelled from the bores through ports 33, 34 in the sides of the rotor respectively.

In order to adjust the degree of eccentricity of the rings 31, 32, there is provided a servo mechanism which is supplied with liquid at high pressure derived from the outlet 17 of the pump, the servo mechanism comprising a pair of pistons 35, 36 acting against the rings 31, 32 respectively. Disposed to act against adjacent portions of the respective rings, at positions diametrically opposite to the positions of the pistons 35, 36 is a lever 37, the lever being fulcrummed on a portion of the body 10 so that in accordance with the pressures acting upon the pistons 35, 36 respectively, the rings 31, 32 are maintained in such relationship that their eccentricity with respect to the axis of rotation of the rotor always remains equal.

The pistons 35, 36 are of differing diameters, and the pistons 36 is backed by a spring 38. Liquid supply to cylinders 35a, 36a containing the pistons 35, 36 respectively is controlled by a spring loaded spool valve 39. The spool valve 39 is supplied at one of its ends adjacent to the cylinder **36*a* containing the piston 36 with liquid at the outlet pressure from the pump through passages 40, 41. Through the passage 40, the cylinder 36*a* containing the piston 36 is also subjected to this pressure. The spool valve 39 controls flow of liquid at this pressure through a passage 42 which communications with the bore containing the piston 35. As shown, a land 39*a* upon the spool valve 39 cuts off the supply of liquid to the 35*a* containing the piston 35, but if the spool valve 39 is moved to the left, a passage 43 communicating with the 36*a* containing the piston 36 will be opened to the 35***a* containing the piston 35. This will cause a reduction in the eccentricity of both the rings 31, 32 of the pump so as to reduce the output volume of the pump as a whole. Such reduction is the result of an increase in the outlet pressure of the pump. If, however, the spool valve 39 moves to the right, the liquid in the 35*a* containing the piston 35 will be allowed to escape through a portion of the body containing the spring 44 for the spool valve 39, and thence to the interior of the body through a passage (not shown) which is at the pressure of the inlet 16 of the pump. Escape of liquid from the 35*a* containing the piston 35 will permit this to move to increase the eccentricity of the ring 31, and this in turn, will cause a similar change in the eccentricity of the ring 32 and corresponding movement of the spring loaded piston 36.

Having thus described my invention what I claim as new and desire to secure by Letters Patent is:

1. A radial piston type pump or motor comprising a body, an inlet and an outlet in the body, a rotor mounted within the body, two axially spaced rows of pistons movable in radial bores in the rotor, the bores communicating in turn with the inlet and with the outlet in the body, a pair of rings defining respective annular inner surfaces with which the rows of pistons engage respectively, to cause the same to be reciprocated as the rotor rotates, the rings being capable of being disposed in positions in which said surfaces are eccentric to one another with respect to an axis of rotation of the rotor, the eccentricity of the respective surfaces of the rings being of equal magnitude with respect to said axis and at opposite sides of the axis, a pair of side by side control pistons arranged at the same side of said rings to act against the outsides of the rings respectively, passage means for entry of fluid under pressure to these pistons to control the eccentricity of the rings respectively, said passage means being capable of communicating with the outlet, the passage means including a bore containing a spool valve for controlling the supply of fluid to the two pistons respectively and said control pistons being of different sizes, with the piston of smaller size being open to high pressure fluid at all times and the piston of larger size being open to high pressure fluid under the control of the spool valve, a valve housing having a longitudinal chamber and a pair of ports, each port communicating with a cylinder in which the control pistons are mounted, a third port supplying fluid at the outlet pressure to the chamber via the cylinder of smaller diameter and the port communicating with the chamber, and subjecting the piston in the smaller cylinder to such outlet pressure, said spool valve having axially spaced lands and being movable in the chamber which constitutes the bore of the passage means, spring means within the valve housing cooperable with the spool valve to move the valve to a position in which one of the lands closes the port providing communication between the chamber and the cylinder of larger diameter and the other land opens the port providing communication between the chamber and the cylinder of smaller diameter, a fourth port providing communication between the cylinder of smaller diameter and the chamber between the spaced lands of the valve, so that upon an increase in the outlet pressure, the valve is moved against the action of the spring means to move the land to open the port between the chamber and the cylinder of larger diameter, whereby the cylinder of larger diameter communicates with the cylinder of smaller diameter via the chamber and fourth port to cause a reduction in eccentricity of both rings to reduce the output volume, while upon a reduction in outlet pressure, the spring means moves the spool valve in the opposite direction to allow fluid in the cylinder of larger diameter to escape through the portion of the valve causing containing the spring means to the body interior at the inlet pressure whereby the piston and the cylinder of larger diameter moves to increase the eccentricity of the ring associated therewith and in turn effect a similar change in the eccentricity of the ring associated with the piston in the cylinder of smaller diameter.

* * * * *